US009003719B2

(12) United States Patent
Kwartler et al.

(10) Patent No.: US 9,003,719 B2
(45) Date of Patent: Apr. 14, 2015

(54) SLIDING LOCKING ACTUATOR FOR AUTOMATIC TILT MECHANISM

(71) Applicants: Anatol Kwartler, Silver Lake, OH (US); Paul B. Blackwelder, Medina, OH (US); Andrew J. L. Hartman, Wooster, OH (US); Rexford R. Mast, Wooster, OH (US)

(72) Inventors: Anatol Kwartler, Silver Lake, OH (US); Paul B. Blackwelder, Medina, OH (US); Andrew J. L. Hartman, Wooster, OH (US); Rexford R. Mast, Wooster, OH (US)

(73) Assignee: The Will-Burt Company, Orrville, OH (US)

( * ) Notice: Subject to any disclaimer, the term of this patent is extended or adjusted under 35 U.S.C. 154(b) by 0 days.

(21) Appl. No.: 14/211,200

(22) Filed: Mar. 14, 2014

(65) Prior Publication Data

US 2014/0259986 A1 Sep. 18, 2014

Related U.S. Application Data

(60) Provisional application No. 61/792,314, filed on Mar. 15, 2013.

(51) Int. Cl.
*E04H 12/34* (2006.01)
*E04H 12/18* (2006.01)

(52) U.S. Cl.
CPC ..... *E04H 12/18* (2013.01); *E04H 12/182* (2013.01)

(58) Field of Classification Search
CPC ..... E04H 12/18; E04H 12/182
USPC ..... 52/115–118; 248/519, 523; 212/292, 212/293, 297, 299; 254/93 H, 89 H; 290/44–45; 412/132 B
See application file for complete search history.

(56) References Cited

U.S. PATENT DOCUMENTS

| | | | | | |
|---|---|---|---|---|---|
| 3,778,940 | A * | 12/1973 | Blecken | 52/116 |
| 3,992,831 | A * | 11/1976 | Bukovitz et al. | 52/116 |
| 4,000,750 | A * | 1/1977 | Becher | 135/16 |
| 4,606,155 | A * | 8/1986 | Bukovitz et al. | 52/116 |
| 4,903,442 | A * | 2/1990 | Trommen | 52/116 |
| 5,269,386 | A * | 12/1993 | Schivley et al. | 175/211 |
| 5,438,805 | A * | 8/1995 | McCrary | 52/116 |
| 5,697,457 | A * | 12/1997 | Back | 173/185 |
| 2008/0127872 | A1* | 6/2008 | Hall | 114/91 |
| 2008/0210469 | A1* | 9/2008 | Volkel et al. | 175/45 |
| 2009/0019794 | A1* | 1/2009 | Centelles Vilalta | 52/115 |
| 2010/0313495 | A1* | 12/2010 | Grant | 52/116 |
| 2011/0162296 | A1* | 7/2011 | Benson | 52/116 |

* cited by examiner

*Primary Examiner* — Beth Stephan
(74) *Attorney, Agent, or Firm* — Fay Sharpe LLP

(57) ABSTRACT

A mast assembly including a locking actuator for locking a cradle of the mast in position. The locking actuator includes a housing having a first lock pin extending in a first direction and a movable member supported by the housing having a second lock pin extending in a second direction opposite the first, the locking actuator being slideably mounted to the cradle for sliding movement along an axis parallel to an axis of extension/retraction of the locking actuator. When the locking actuator is extended the first and second lock pins are inserted into respective lock holes in a base member thereby locking the cradle against pivoting movement relative to the base member.

19 Claims, 5 Drawing Sheets

SLIDING LOCKING ACTUATOR FOR AUTOMATIC TILT MECHANISM

BACKGROUND

The present exemplary embodiment relates to masts. It finds particular application in conjunction with tilting of telescoping masts for antennas, lights and other payloads, and will be described with particular reference thereto. However, it is to be appreciated that the present exemplary embodiment is also amenable to other like applications.

Telescoping masts generally include multiple tube or lattice structure sections that are configured to telescope or nest within each other. A drive system is typically configured to deploy and/or retract the tubes between extended and retracted configurations. Locks or latches may be used to lock each tube to its adjacent tube or tubes when in the extended configuration.

Military and commercial mast users often have a need to transport a telescoping mast to the location where it will be deployed. It is often desired to have these masts deployed and ready for use immediately upon arriving on location. In addition, some mast systems would be unable to fit in aircraft or trucks, or clear bridges and other overhead encumbrances without bringing the mast to a horizontal position for transport. One means to bring the mast to a horizontal position is by using a tilting mechanism. A tilting mechanism can be manual or automated. In cases where the masts and payloads are large or where time to readiness is critical an automated version is desired.

One version of an automated tilting mechanism uses an actuator to provide a rotational moment to tilt the mast which is mounted in a pivoting cradle. This rotational moment can be provided by an electromechanical, pneumatic or a hydraulic actuator, or through other mechanical means using a motor and gears, etc. An automated tilting mechanism also generally includes a locking mechanism to "lock" the pivoting cradle with the mast in the horizontal and vertical positions. When the mast carrying cradle is in the horizontal position it needs to be secured to avoid damage to the mast or payload during transportation. When the mast carrying cradle is in the vertical position it needs to be secured to provide a stable platform for the payload to function properly.

One approach to lock the tilting cradle carrying a mast in either position is by moving a large pin into a bushing that is securely fastened to the automated tilt mechanism base. To prevent rotational movement of the cradle and mast due to mast payload induced pivoting and torsional loads on the mast, four locking actuators have generally been needed, each actuator configured to a locking pin into and out of engagement with a lock hole.

BRIEF DESCRIPTION

In the present disclosure, a single locking actuator is configured to shuttle oppositely extending pins in and out locking engagement with respective bushings. By utilizing a single actuator to move at least two pins, it is possible to reduce the number of actuators needed for a given application, thereby reducing complexity and cost.

In accordance with one aspect, a mast assembly comprises a base member, a mast, a cradle supporting an end of the mast and being pivotally mounted to the base member for movement between first and second positions for changing an orientation of the mast, and at least one locking actuator for locking the cradle in at least one of the first or second positions, the locking actuator including a housing having a first lock pin extending in a first direction and a movable member supported by the housing having a second lock pin extending in a second direction opposite the first, the locking actuator being slideably mounted to the cradle for sliding movement along an axis parallel to an axis of extension/retraction of the locking actuator. When the locking actuator is extended the first and second lock pins are inserted into respective openings in the base member thereby locking the cradle against pivoting movement relative to the base member, whereby when the locking actuator is retracted the first and second lock pins are withdrawn from the openings in the base member thereby permitting pivoting movement of the cradle relative to the base member.

The cradle can be pivotable about a cradle axis, and the at least one locking actuator can extend/retract along an axis parallel to the cradle axis. The at least one locking actuator can be at least one of an electric actuator, a hydraulic actuator, or a pneumatic actuator. The mast can include a telescoping mast having a plurality of nesting sections. The first and second lock pins can be aligned along a common axis.

A center stop can be supported on at least one of the locking actuator or the cradle for limiting an extent to which terminal ends of the first and second lock pins can be drawn towards each other during retraction of the locking actuator either by limiting movement of one of the lock pins or by limiting movement of the housing of the locking actuator. The center stop can be positioned between the first and second lock pins. The assembly can also include at least one outer stop surface against which a lock pin impinges when fully inserted into the opening in the base member, the outer stop surface limiting an extent to which the first and second lock pins can be separated from each other during extension of the locking actuator.

The base member can include a bottom wall and spaced apart side walls extending in a common direction from the bottom wall, each side wall including at least one opening into which a respective lock pin can be inserted when the lock actuator is in the extended position. The cradle can be mounted between the side walls and each side wall can include a stowed lock hole and a deployed lock hole spaced from the stowed lock hole, each stowed lock hole receiving one of the first or second lock pins of the locking actuator when the mast is in a stowed position, and each deployed lock hole receiving one of the first or second lock pins of the locking actuator when the mast is in the deployed position.

In accordance with another aspect, a tilt mechanism for an associated mast comprises a mountable base member, a cradle for supporting the associated mast, the cradle pivotally mounted to the base member for movement between first and second positions for changing an orientation of the associated mast, and at least one locking actuator for locking the cradle in at least one of the first or second positions, the locking actuator including a housing having a first lock pin extending in a first direction and a movable member supported by the housing having a second lock pin extending in a second direction opposite the first, the locking actuator being slideably mounted to the cradle for sliding movement along an axis parallel to an axis of extension/retraction of the locking actuator. When the locking actuator is extended the first and second lock pins are inserted into respective openings in the base member thereby locking the cradle against pivoting movement relative to the base member, and whereby when the locking actuator is retracted the first and second lock pins are withdrawn from the openings in the base member thereby permitting pivoting movement of the cradle relative to the base member.

The cradle can be pivotable about a cradle axis, and the at least one locking actuator can extend/retract along an axis parallel to the cradle axis. The at least one locking actuator can be at least one of an electric actuator, a hydraulic actuator, or a pneumatic actuator. The first and second lock pins can be aligned along a common axis.

A center stop can be supported on at least one of the locking actuator or the cradle for limiting an extent to which terminal ends of the first and second lock pins can be drawn towards each other during retraction of the locking actuator either by limiting movement of one of the lock pins or by limiting movement of the housing of the locking actuator. The center stop can be positioned between the first and second lock pins. The mechanism can further include at least one outer stop surface against which a lock pin impinges when fully inserted into the opening in the base member, the outer stop surface limiting an extent to which the first and second lock pins can be separate from each other during extension of the locking actuator.

The base member can include a bottom wall and spaced apart side walls extending in a common direction from the bottom wall, each side wall including at least one opening into which a respective lock pin can be inserted when the lock actuator is in the extended position. The cradle can be mounted between the side walls and each side wall includes a stowed lock hole and a deployed lock hole spaced from the stowed lock hole, each stowed lock hole one of the first or second lock pins of the locking actuator when the mast is in a stowed position, and each deployed lock hole receiving one of the first or second lock pins of the locking actuator when the mast is in the deployed position.

In accordance with another aspect, an automatic tilting mechanism for a mast includes locking pins mounted on a rotating cradle so only one set of moving pins is used to secure the cradle in a given position. The two locking pins are attached to opposite ends of an actuator that is mounted on a sliding mechanism that is attached to the tilting cradle. When the cradle reaches the horizontal or vertical position, for example, a signal is given to extend the actuator. The actuator extends until one locking pin is fully inserted into its associated base bushing (e.g., lock hole in an adjacent flange) and then the actuator slides on the sliding mechanism in the opposite direction until the other locking pin is fully inserted into its associated bushing and thus the pins lock the cradle in position. When the cradle needs to be rotated (e.g., moved again to the horizontal or vertical position) the process is reversed. The actuator is retracted which extracts the locking pins from their associated bushings. The order in which the pins are inserted or extracted from their associated bushings does not matter as the actuator slides from side to side.

Through the use of a sliding locking actuator in accordance with the disclosure only one actuator is needed to engage two opposed locking pins. This eliminates the cost and complexity of multiple actuators and associated limit switches and control functions. It also eliminates two additional locking pins and bushings and their associated cost. The reduction in components and their related electrical connections increases the reliability, lowers the life cycle cost, and improves the overall quality of the automated tilting mechanism. The sliding locking actuator concept could be applied to other apparatus or mechanisms where opposing pins or other devices need to be engaged at the same time.

DETAILED DESCRIPTION

Figure 1:
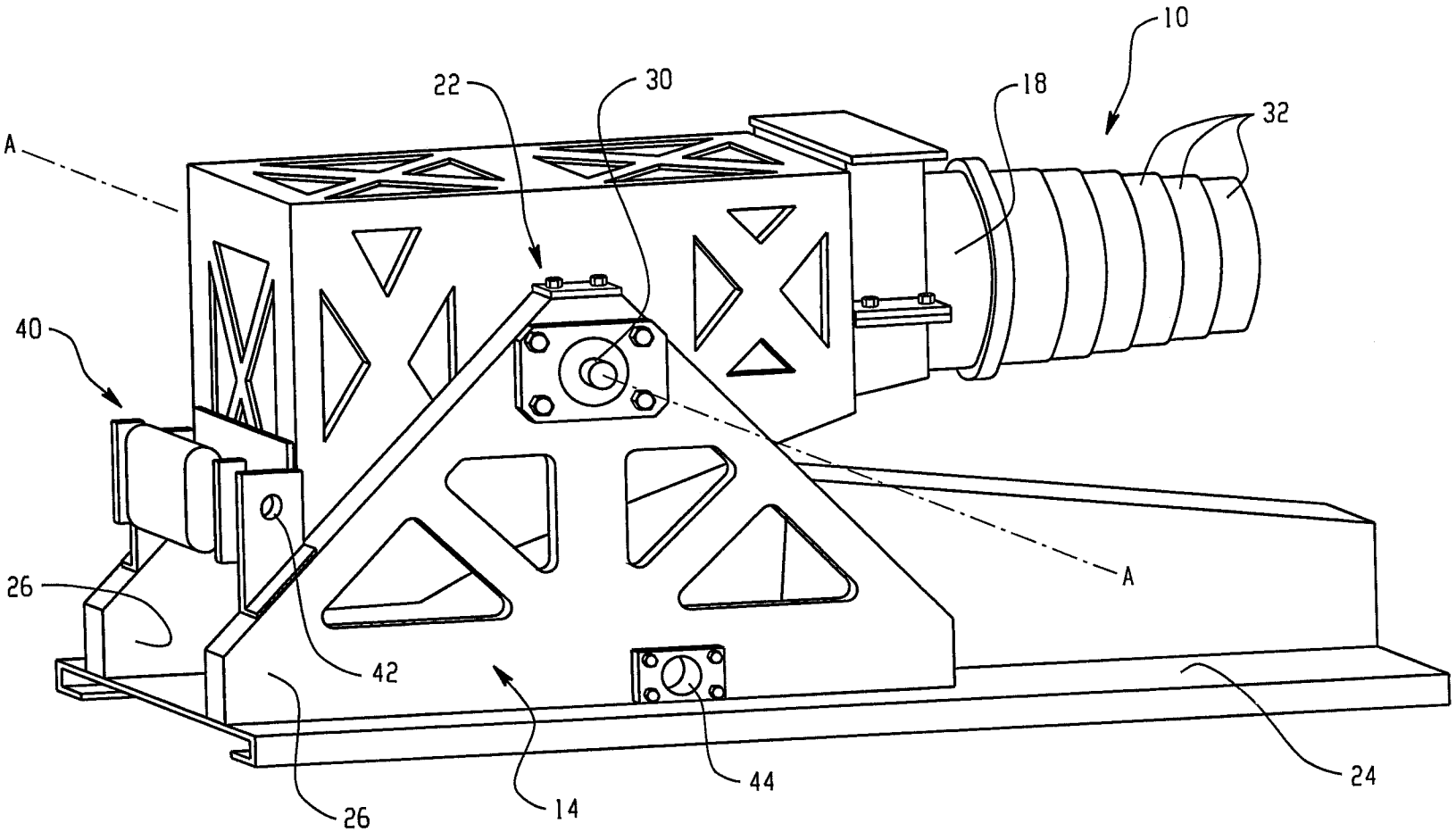
FIG. 1 is a perspective view of an exemplary mast assembly including a tilt mechanism in accordance with the present disclosure.

With reference to FIG. 1, a mast assembly in accordance with the present disclosure is illustrated and identified generally by reference numeral 10. The mast assembly 10 generally is comprised of a base member 14 that is mountable to a surface such as a roof of a vehicle (not shown), a mast 18, which can be a fixed length mast or a telescoping mast as illustrated, and a cradle 22 supporting the mast 18 and being pivotally mounted to the base member 14 for movement between a horizontal position as shown and a vertical position.

The base member 14 includes a bottom wall 24 and spaced apart side walls 26 that extend in a common direction from the bottom wall 24. The cradle 22 is mounted to the base member 24 for pivoting movement by a pair of bearings 30 or the like that are secured to each of the side walls 26. The cradle 22 and, thus, the mast 18 is pivotable about a cradle axis A that extends through bearings 30.

In operation, the mast assembly 10 is generally maintained in the stowed position as shown in FIG. 1 until such time as the mast is to be deployed. In a vehicle mounted application, the mast assembly 10 will remain in the stowed position during transport of the vehicle from one location to another. Upon arrival at a destination where the mast assembly 10 is to be used, the cradle 22 will be pivoted about the cradle axis A to a position such that the mast 18 is oriented vertically, for example. Once in the vertical orientation, the mast, if a telescoping mast can be extended to elevate a payload at the distal end of the mast. A wide variety of drive mechanisms for extending and retracting a telescoping mast are available, and virtually any such drive system can be used to extend and retract the plurality of nesting sections 32 of the mast 18 without departing from the scope of the present disclosure. When the mast is no longer in use or it is desired to move the vehicle to which the assembly is mounted to a new location, the telescoping mast 18 is retracted and the cradle 22 is then rotated from the vertical position back to the horizontal stowed position as shown in FIG. 1.

In accordance with the present disclosure, the mast assembly 10 further includes at least one sliding locking actuator 40 for locking the cradle 22 in the horizontal and vertical orientations. The locking actuator 40 is supported for movement on a surface of the cradle 22 and is configured to extend and retract first and second lock pins into and out of respective down or stowed lock holes 42 and up or deployed lock holes 44.

Figure 2:
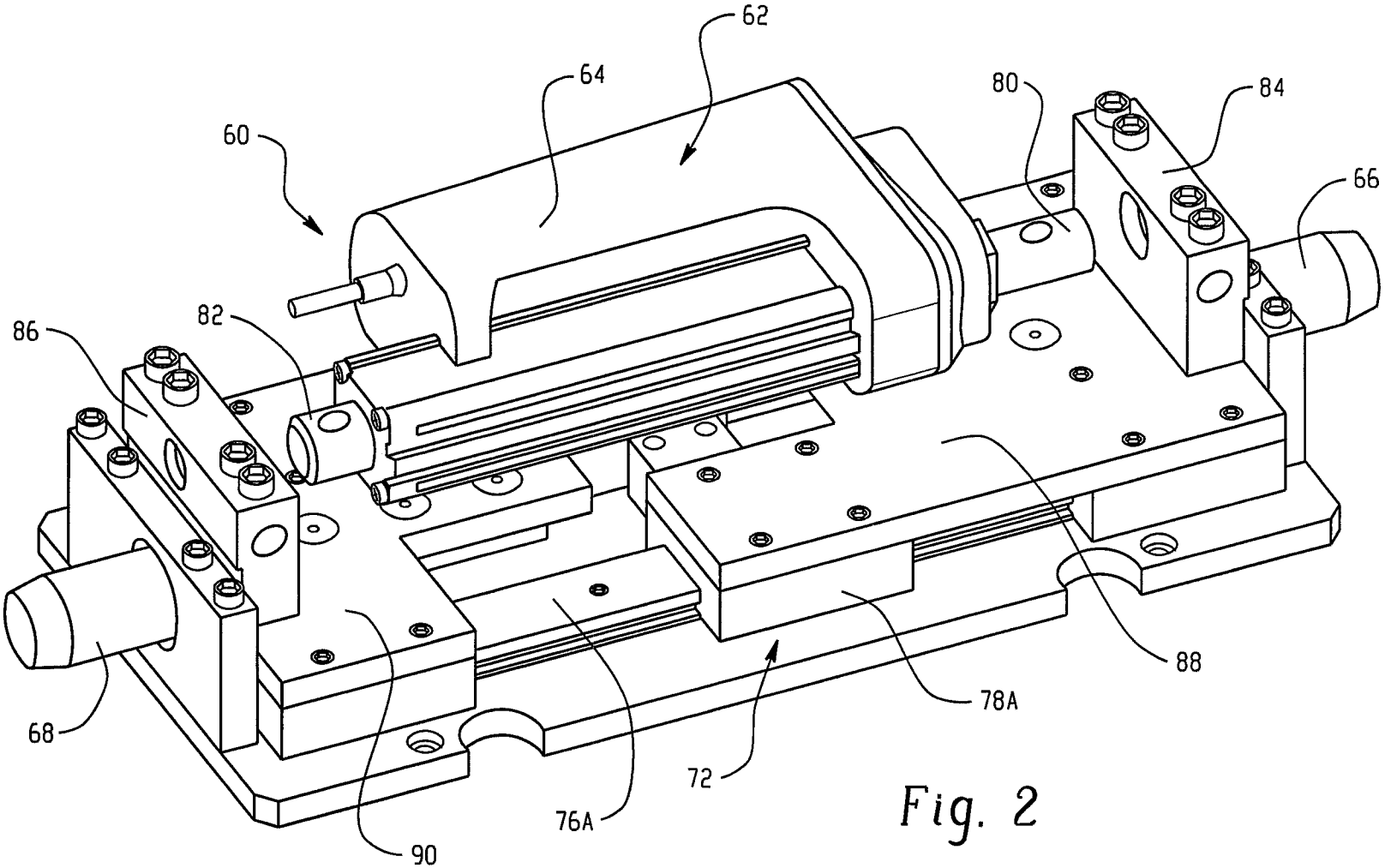
FIG. 2 is a perspective view of a locking actuator mechanism for securing the mast in a position in accordance with the disclosure.

With reference to FIGS. 2-5 and initially to FIG. 2, a locking actuator mechanism 60 in accordance with the present disclosure is illustrated. The locking actuator mechanism 60 of FIG. 2 is similar to the locking actuator mechanism of FIG. 1, but with the many of the components of the mast assembly removed for clarity. The locking actuator mechanism 60 includes a locking actuator 62, which in the illustrated embodiment is an electric actuator such as a lead screw, ball screw or a solenoid or the like, but it will be appreciated that the locking actuator 62 can be a pneumatic or hydraulic actuator as desired. The locking actuator 62 includes a housing 64 in which the components of the actuator (solenoid, electric motor, etc) are contained and/or supported. A first lock pin 66 is associated with the movable member or component (e.g., piston, ball nut, lead screw etc.) of the locking actuator 62 while a second lock pin 68 is fixed to the housing 64 of the locking actuator 62. Accordingly, the lock pin 66 is adapted to extend and retract relative to the housing 64 and second lock pin 68 during operation of the locking actuator 64.

Figure 3:
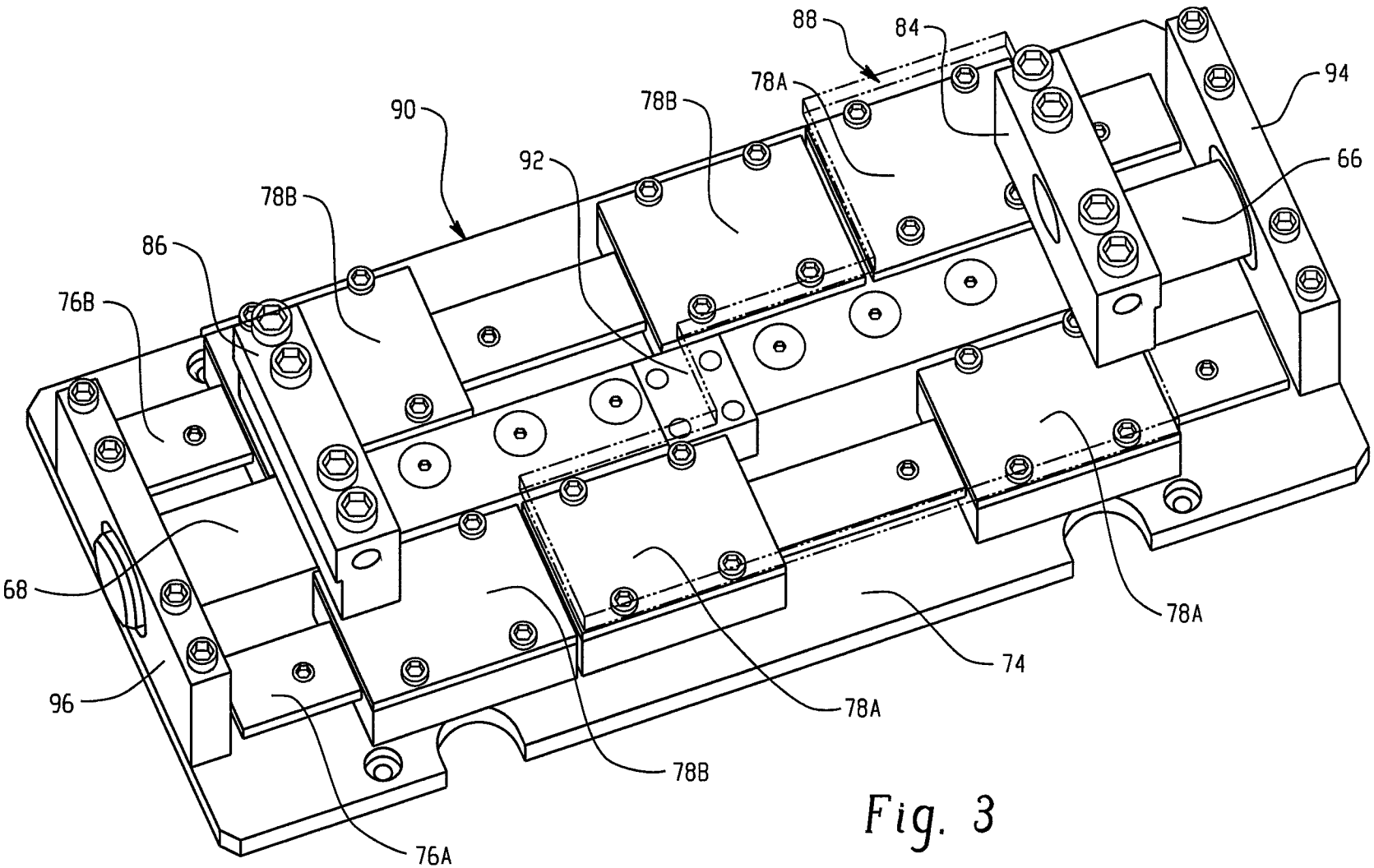
FIG. 3 is a perspective view of the locking actuator mechanism of FIG. 2 with the locking actuator removed to expose the stops and sliding mounts in a first position (unlocked)

The locking actuator 62 is supported on a sliding base assembly 72 that includes a base member 74 that is mountable to a surface, such as the cradle 22 of FIG. 1. The base member 74 includes a pair of laterally spaced apart rails 76A and 76B that support sliding block set 78A and sliding block set 78B (FIG. 3). As will be described below, the locking actuator 62 is supported on sliding block platforms that are in turn supported respectively by sliding block sets 78A and 78B.

It will be appreciated that the locking actuator 62 in FIG. 2 is shown in a retracted position while lock pins 66 and 68 are illustrated in their extended (e.g., locked) positions. As such, respective locking actuator shafts 80 and 82 are shown in a retracted state and separated from respective blocks 84 and 86. This is merely for illustrative purposes and, in practice, shafts 80 and 82 will be fixed to blocks 84 and 86 for moving the lock pins 66 and 68 into and out of lock holes (not shown in FIGS. 2-5). Accordingly, it will be appreciated that blocks 84 and 86 are each mounted to respective sliding platforms 88 and 90 while the housing 64 of the actuator 62 extends between both sliding platform 88 and sliding platform 90 thereby allowing the actuator 62 to extend and retract each of the diametrically opposed lock pins 66 and 68, as will now be described in connection with FIGS. 3-5.

Beginning with FIG. 3, sliding block set 78A and sliding block set 78B are shown in the unlocked position corresponding to a withdrawn or retracted state of the actuator 62. Sliding platform 88 is illustrated in phantom in FIG. 3, while sliding platform 90 has been removed for illustrative purposes. In this position, the platforms 88 and 90 and/or sliding block sets 78A and 78B are each engaged with a central stop block 92 that limits each platforms relative movement towards the other platform.

Figure 4:
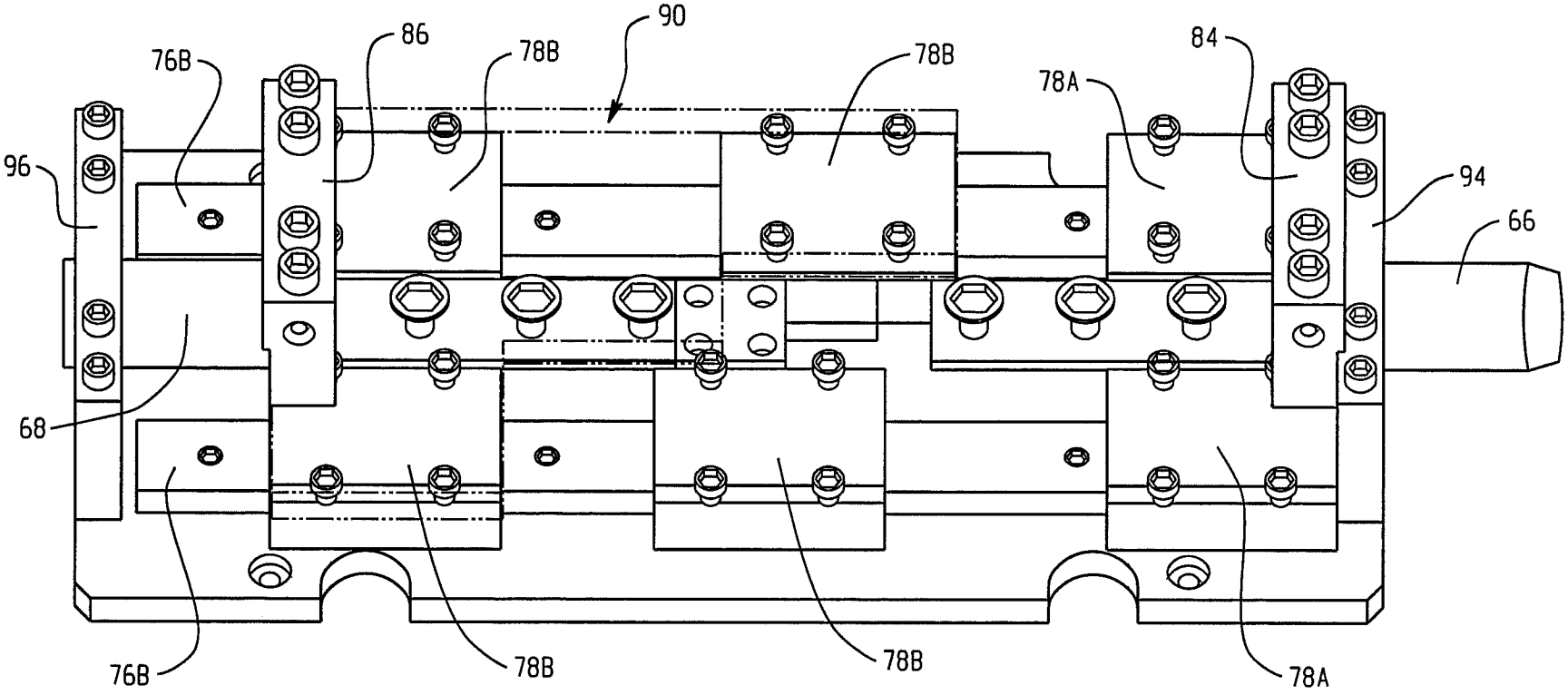
FIG. 4 is a perspective view of the locking actuator mechanism of FIG. 2 with the locking actuator removed to expose the stops and sliding mounts in a second position (one side locked)

In FIG. 4, sliding platform 90 is illustrated in phantom while sliding platform 88 has been removed for illustrative purposes. Sliding block set 78A is shifted to the right to a position corresponding to a locked position whereat lock pin 66 is fully extended for receipt in a lock hole, such as up or down hole 42 or 44 shown in FIG. 1. Block 84, which is supported on sliding platform 88, is engaged with outer stop block 94 which limits the outward movement of sliding platform 88 away from sliding platform 90. This position corresponds to a partially extended position of the actuator 62. Sliding platform 90 remains free to move left away from sliding platform 88.

Figure 5:
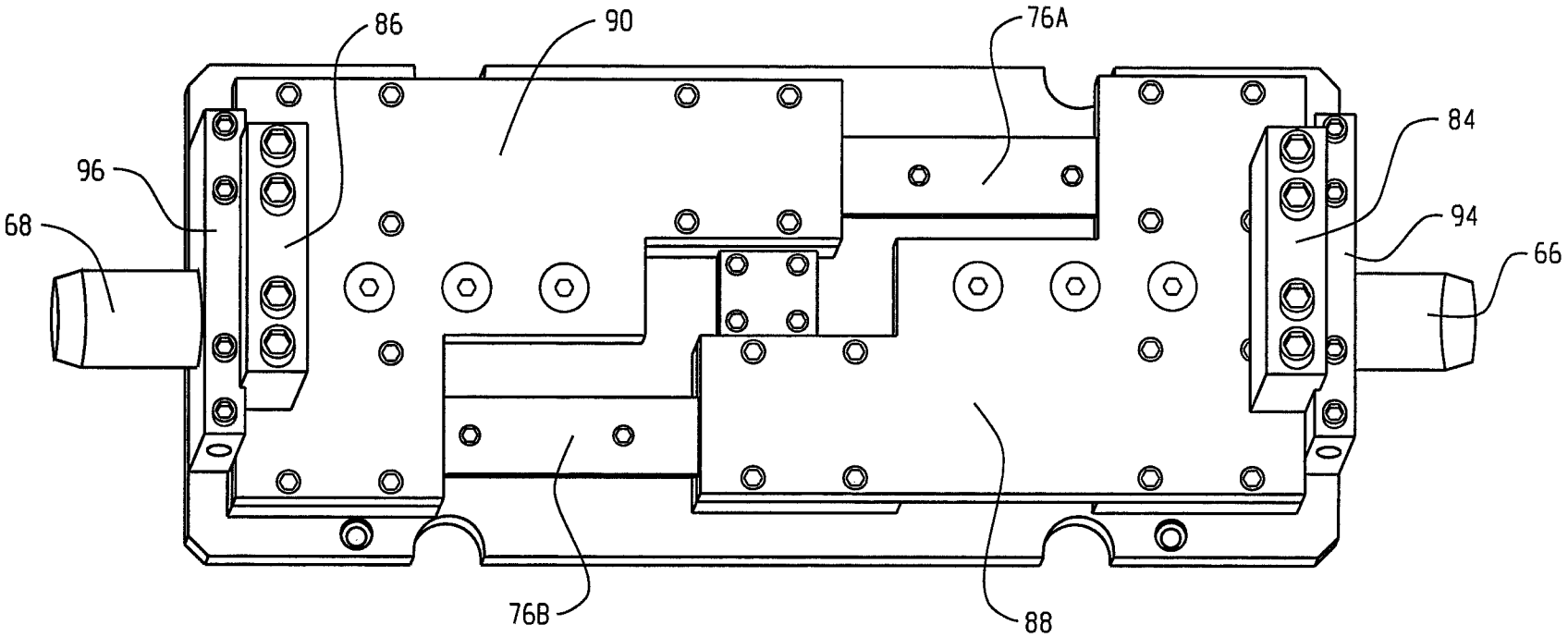
FIG. 5 is a perspective view of the locking actuator mechanism of FIG. 2 with the locking actuator removed to expose the stops and sliding mounts in a third position (locked).

Turning now to FIG. 5, the actuator assembly 60 is illustrated in a fully extended configuration with both lock pins 66 and 68 fully extended. In this position, both of blocks 84 and 86 are engaged with respective outer stop blocks 94 and 96. Sliding platforms 88 and 90 are restricted from moving any further apart. In this position, the actuator 62 is fully extended and lock pins 66 and 68 are fully extended for receipt in corresponding lock holes.

Retraction of the actuator mechanism is the opposite of extension. As will be appreciated, as the actuator is retracted, sliding platforms 88 and 90 are drawn together thereby retracting locking pins 66 and 68 until both platforms 88 and 90 engage center stop block 92. Locking pins 66 and 68 may be withdrawn simultaneously or sequentially depending on frictional forces and/or other influences, but the order of withdrawal is generally not significant. It should now be appreciated that the present disclosure sets forth a locking mechanism having a single actuator that has the ability to lock/unlock the cradle on two opposing sides while harnessing the force of one actuator that extends from one end. This feature is achieved by the actuator free sliding in either locking pin receptacle direction across the cradle against hard stop thus allowing random initiation of either locking pin insertion/extraction. The locking mechanism is mounted to the cradle and travels therewith thus allowing the locking mechanism to lock/unlock the cradle in two (2) cradle positions (e.g., vertical/horizontal, stowed/deployed, etc.).

As described, thrusting of two (2) locking pins in opposing directions with one (1) actuator that thrusts in only one direction is possible by guiding the pins using sliding platforms and limiting the travel distance of each pin slide with hard stops, thus also limiting the distance the actuator travels (floats) in any one direction while extending.

The locking order (i.e., which pin engages its respective receptacle bushing or lock hole) is typically random. Initially and prior to the collision of moving slides with hard stops, friction "stimulates" the direction of motion. Once any one pin slide reaches its hard stop and thus the pin it carries is inserted into its respective lock hole, that slide stops moving and therefore the actuator stops moving in that direction. The actuator continued extension then thrusts the opposite pin slide to insert the opposite pin into its receptacle bushings. Both locking pins are in the locked position (fully inserted into their respective receptacle bushings) when the actuator is in the fully extended position as limited by an integral electromechanical limit switch.

To unlock, the actuator is retracted. The retracting force of the actuator slides the pin carrying sliding platforms away from the hard stops to extract the pins from their respective receptacle bushings. Initially and prior to the collision of any one moving sliding platform with a center stop block, the unlocking order (i.e., which pin begins to disengage from its respective receptacle bushing) is generally random and is also "stimulated" by friction. While the actuator is retracting one of the locking pin sliding platforms will be first to collide with a stop block (hard stop) in the center of the mechanism which will stop its motion. At this position its pin is fully extracted. The continued retraction of the actuator then moves the opposing (other) locking pin sliding platform towards the center of the mechanism thus extracting the opposite pin. Both locking pins are in the unlocked position (fully extracted into their respective receptacle lock hole bushings) when the actuator is in the fully retracted position as limited by the integral electromechanical limit switch of the actuator.

It will now be appreciated that the present disclosure sets forth a single actuator that floats (e.g., slides) with hard stops limiting the sliding travel to enable both actuator ends to move a pin at each end in/out of receiving holes. This is in contrast to a traditional use of actuators where one end of the actuator is "anchored" to a non-moving structure). The single floating actuator is supported by the pivoting cradle for movement in space to different locking/unlocking locations, and is thus able to perform the same locking/unlocking function of in two different cradle positions (e.g., horizontal mast position and vertical mast position). Accordingly, the single actuator of the present disclosure makes possible locking/unlocking a pivoting cradle in two orientations using four (4) engagements, two per cradle position.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A mast assembly comprising:

a base member having a plurality of openings;

a mast;

a cradle supporting an end of the mast and being pivotally mounted to the base member for movement between first and second positions for changing an orientation of the mast; and at least one locking actuator for locking the cradle in at least one of the first or second positions, the locking actuator including a housing having a first lock pin extending in a first direction and a movable member supported by the housing having a second lock pin extending in a second direction opposite the first direction, the locking actuator extendable and retractable, the locking actuator being slideably mounted to the cradle for sliding movement along an axis parallel to an axis of extension/retraction of the locking actuator;

whereby when the locking actuator is extended the first and second lock pins are inserted into the openings in the base member thereby locking the cradle against pivoting movement relative to the base member, and whereby when the locking actuator is retracted the first and second lock pins are withdrawn from the openings in the base member thereby permitting pivoting movement of the cradle relative to the base member.

2. The mast assembly as set forth in claim 1, wherein the cradle is pivotable about a cradle axis, and the at least one locking actuator extends/retracts along an axis parallel to the cradle axis.

3. The mast assembly as set forth in claim 1, wherein the at least one locking actuator is at least one of an electric actuator, a hydraulic actuator, or a pneumatic actuator.

4. The mast assembly as set forth in claim 1, wherein the mast includes a telescoping mast having a plurality of nesting sections.

5. The mast assembly as set forth in claim 1, wherein the first and second lock pins are aligned along a common axis.

6. The mast assembly as set forth in claim 1, further comprising a center stop supported on at least one of the locking actuator or the cradle for limiting an extent to which terminal ends of the first and second lock pins can be drawn towards each other during retraction of the locking actuator either by limiting movement of one of the lock pins or by limiting movement of the housing of the locking actuator.

7. The mast assembly as set forth in claim 6, wherein the center stop is positioned between the first and second lock pins.

8. The mast assembly as set forth in claim 1, further comprising at least one outer stop surface against which one of the lock pins impinges when fully inserted into one of the openings in the base member, the outer stop surface limiting an extent to which the first and second lock pins can be separated from each other during extension of the locking actuator.

9. The mast assembly as set forth in claim 1, wherein the base member includes a bottom wall and spaced apart side walls extending in a common direction from the bottom wall, each side wall including at least one of said openings into which one of the lock pins can be inserted when the lock actuator is in the extended position.

10. The mast assembly as set forth in claim 9, wherein the cradle is mounted between the side walls and each side wall having the openings including a stowed lock hole and a deployed lock hole spaced from the stowed lock hole, each stowed lock hole receiving one of the first or second lock pins of the locking actuator when the mast is in a stowed position, and each deployed lock hole receiving one of the first or second lock pins of the locking actuator when the mast is in the deployed position.

11. A tilt mechanism for an associated mast comprising:

a mountable base member having a plurality of openings;

a cradle for supporting the associated mast, the cradle pivotally mounted to the base member for movement between first and second positions for changing an orientation of the associated mast; and at least one locking actuator for locking the cradle in at least one of the first or second positions, the locking actuator including a housing having a first lock pin extending in a first direction and a movable member supported by the housing having a second lock pin extending in a second direction opposite the first direction, the locking actuator extendable and retractable, the locking actuator being slideably mounted to the cradle for sliding movement along an axis parallel to an axis of extension/retraction of the locking actuator;

whereby when the locking actuator is extended the first and second lock pins are inserted into the openings in the base member thereby locking the cradle against pivoting movement relative to the base member, and whereby when the locking actuator is retracted the first and second lock pins are withdrawn from the openings in the base member thereby permitting pivoting movement of the cradle relative to the base member.

12. The tilt mechanism as set forth in claim 11, wherein the cradle is pivotable about a cradle axis, and the at least one locking actuator extends/retracts along an axis parallel to the cradle axis.

13. The tilt mechanism as set forth in claim 11, wherein the at least one locking actuator is at least one of an electric actuator, a hydraulic actuator, or a pneumatic actuator.

14. The tilt mechanism as set forth in claim 11, wherein the first and second lock pins are aligned along a common axis.

15. The tilt mechanism as set forth in claim 11, further comprising a center stop supported on at least one of the locking actuator or the cradle for limiting an extent to which terminal ends of the first and second lock pins can be drawn towards each other during retraction of the locking actuator either by limiting movement of one of the lock pins or by limiting movement of the housing of the locking actuator.

16. The tilt mechanism as set forth in claim 15, wherein the center stop is positioned between the first and second lock pins.

17. The tilt mechanism as set forth in claim 11, further comprising at least one outer stop surface against which one of the lock pins impinges when fully inserted into one of the openings in the base member, the outer stop surface limiting an extent to which the first and second lock pins can be separate from each other during extension of the locking actuator.

18. The tilt mechanism as set forth in claim 11, wherein the base member includes a bottom wall and spaced apart side walls extending in a common direction from the bottom wall, each side wall including at least one of said openings into which one of the lock pins can be inserted when the lock actuator is in the extended position.

19. The tilt mechanism as set forth in claim 18, wherein the cradle is mounted between the side walls and each side wall having the openings including a stowed lock hole and a deployed lock hole spaced from the stowed lock hole, each stowed lock hole receiving one of the first or second lock pins of the locking actuator when the mast is in a stowed position, and each deployed lock hole receiving one of the first or second lock pins of the locking actuator when the mast is in the deployed position.

* * * * *